US011738560B2

(12) United States Patent
Okeguchi

(10) Patent No.: US 11,738,560 B2
(45) Date of Patent: Aug. 29, 2023

(54) HEAD CAP, LIQUID DISCHARGE APPARATUS, AND HEAD CAPPING METHOD

(71) Applicant: Muneyuki Okeguchi, Kanagawa (JP)

(72) Inventor: Muneyuki Okeguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/380,184

(22) Filed: Jul. 20, 2021

(65) Prior Publication Data

US 2022/0063278 A1 Mar. 3, 2022

(30) Foreign Application Priority Data

Aug. 25, 2020 (JP) ..... 2020-141472
Jun. 25, 2021 (JP) ..... 2021-106177

(51) Int. Cl.
*B41J 2/165* (2006.01)
*B41J 3/407* (2006.01)

(52) U.S. Cl.
CPC ..... *B41J 2/16511* (2013.01); *B41J 2/16505* (2013.01); *B41J 2/16508* (2013.01); *B41J 2/16535* (2013.01); *B41J 3/4078* (2013.01)

(58) Field of Classification Search
CPC ..... B41J 2/16511; B41J 2/16505; B41J 2/16508; B41J 2/16535
See application file for complete search history.

(56) References Cited

U.S. PATENT DOCUMENTS 5,870,115 A * 2/1999 Kikuchi ..... B41J 2/16508 347/32
2006/0050104 A1 3/2006 Sakakitani
2006/0268053 A1 11/2006 Naruse
2017/0225465 A1 8/2017 Tamaki
2018/0361761 A1 12/2018 Okeguchi et al.
2020/0070499 A1 3/2020 Suzuki et al.
2020/0094582 A1 3/2020 Okeguchi et al.
2021/0162762 A1 6/2021 Okeguchi et al.

FOREIGN PATENT DOCUMENTS

CN 201291637 Y 8/2009
CN 203210848 U 9/2013
CN 107443909 A 12/2017
JP 11-334093 12/1999
JP 2012176531 A 9/2012
JP 2013078940 A * 5/2013 ..... B41J 2/16505
(Continued)

OTHER PUBLICATIONS

U.S. Appl. No. 17/142,297, filed Jan. 6, 2021, Tetsu Morino, et al.
(Continued)

*Primary Examiner* — Sharon Polk
(74) *Attorney, Agent, or Firm* — Harness, Dickey & Pierce, P.L.C.

(57) ABSTRACT

A head cap configured to maintain a head configured to discharge a liquid from nozzles formed in a nozzle surface, the head cap includes a cap configured to cap the nozzle surface of the head, and a holder holding the cap, the holder being detachably attachable to one of a carriage mounting the head and a guide configured to guide the carriage.

14 Claims, 11 Drawing Sheets

(56) References Cited

FOREIGN PATENT DOCUMENTS

| | | | |
|---|---|---|---|
| JP | 2013-136162 | | 7/2013 |
| JP | 2016-112766 | | 6/2016 |
| KR | 20100106851 | A | 10/2010 |
| KR | 101041770 | B1 | 6/2011 |

OTHER PUBLICATIONS

U.S. Appl. No. 17/198,349, filed Mar. 11, 2021, Muneyuki Okeguchi.
CA Extended European Search Report dated Dec. 16, 2021.
Chinese Office action dated Nov. 2, 2022 for corresponding Chinese Patent Application No. CN202110971207.3.
Chinese Office Action dated Jun. 8, 2023 for corresponding Chinese Patent Application No. CN202110971207.3.

* cited by examiner

HEAD CAP, LIQUID DISCHARGE APPARATUS, AND HEAD CAPPING METHOD

CROSS-REFERENCE TO RELATED APPLICATIONS

This patent application is based on and claims priority pursuant to 35 U.S.C. § 119(a) to Japanese Patent Application No. 2020-141472, filed on Aug. 25, 2020, in the Japan Patent Office and Japanese Patent Application No. 2021-106177, filed on Jun. 25, 2021, in the Japan Patent Office, the entire disclosures of which are hereby incorporated by reference herein.

BACKGROUND

Technical Field

Aspects of the present disclosure relate to a head cap, a liquid discharge apparatus, and a head capping method.

Related Art

A liquid discharge apparatus includes a head to discharge a liquid from nozzles formed on a nozzle surface of the head and a maintenance unit to maintain and recover a discharge function of the head. The maintenance unit includes a cap to cap the nozzle surface of the head and a wiper to wipe the nozzle surface of the head, for example.

As a maintenance jig to manually maintenance the head, there is a maintenance tool including a plate-like member that covers the nozzle surface including nozzles in a state of being stacked on the nozzle surface of the head. The maintenance jig includes an exposure portion that exposes a maintenance portion to be subjected to maintenance in the head.

SUMMARY

In an aspect of this disclosure, a head cap configured to maintain a head configured to discharge a liquid from nozzles formed in a nozzle surface, the head cap includes a cap configured to cap the nozzle surface of the head, and a holder holding the cap, the holder being detachably attachable to one of a carriage mounting the head and a guide configured to guide the carriage.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
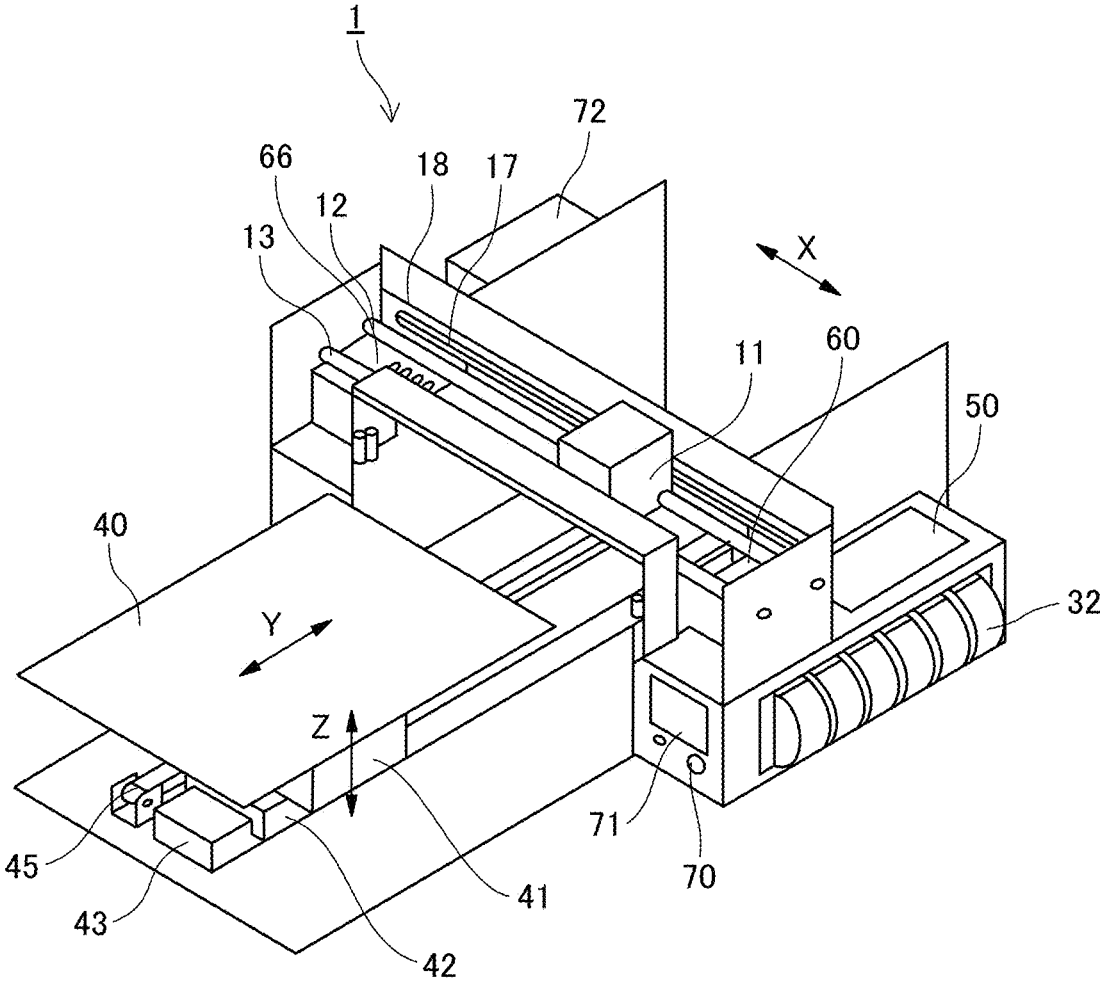
FIG. 1 is a schematic perspective view of a printer as a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below. A printer as a liquid discharge apparatus according to a first embodiment of the present disclosure is described with reference to FIGS. 1 to 3.

FIG. 1 is a schematic perspective view of the printer 1 according to the first embodiment.

Figure 2:
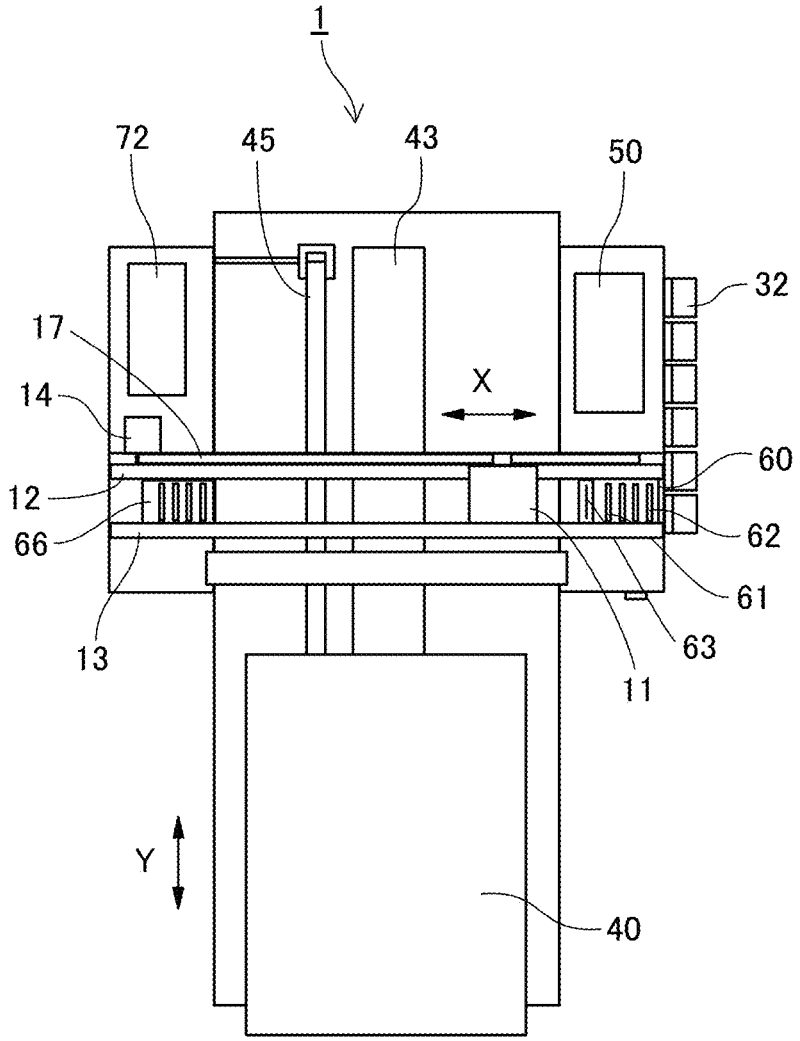
FIG. 2 is a schematic plan view of the printer of FIG. 1.

FIG. 2 is a schematic plan view of the printer 1 of FIG. 1.

Figure 3:
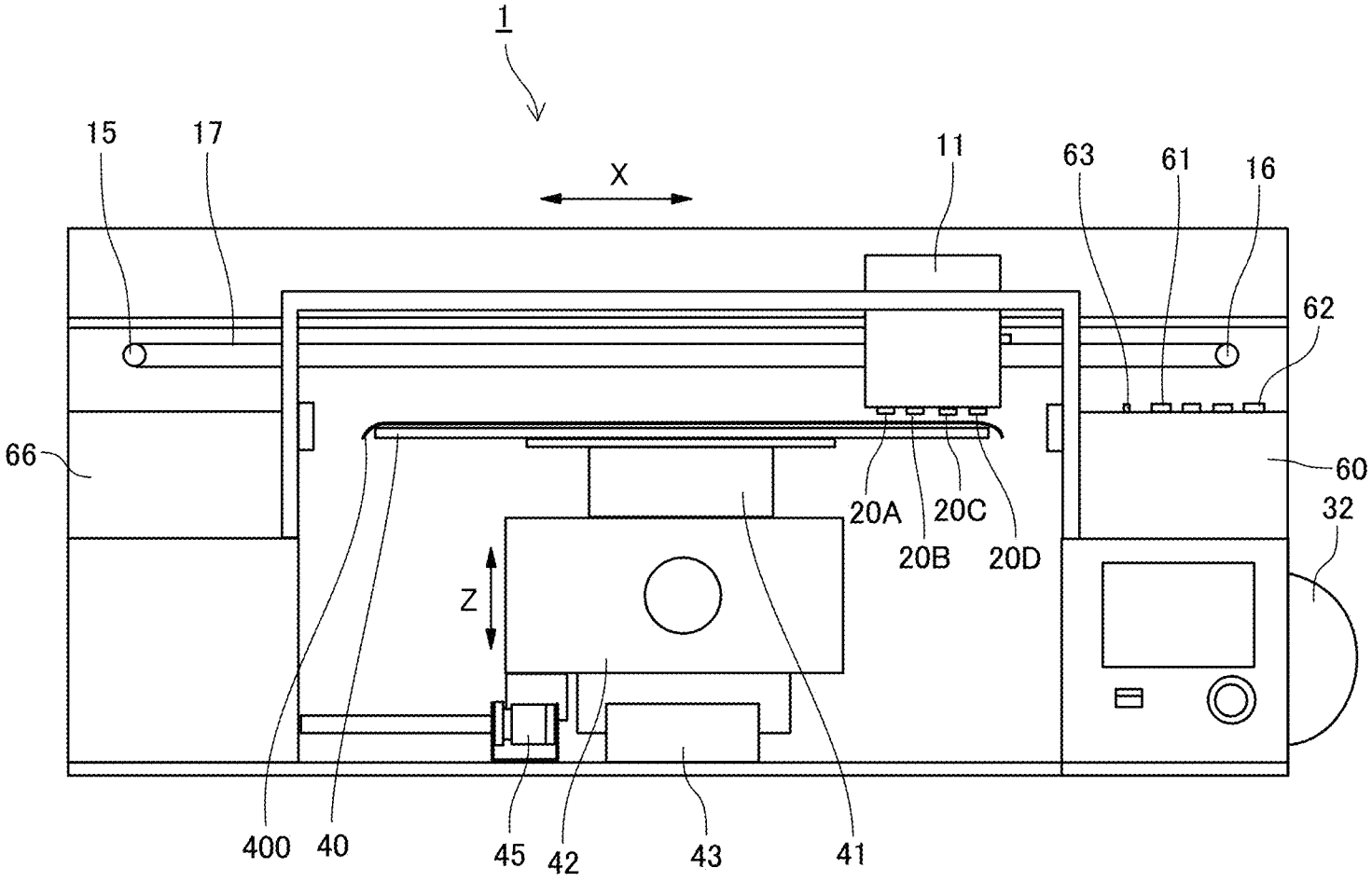
FIG. 3 is a schematic cross-sectional front view of the printer of FIG. 1.

FIG. 3 is a schematic cross-sectional front view of the printer of FIG. 1.

The printer 1 includes multiple heads 20 (20A to 20D), multiple sub tanks, and the carriage 11 as illustrated in FIG. 3. The multiple heads 20 serve as liquid discharge devices to discharge a liquid. The carriage 11 mounts the sub tanks. The multiple heads 20 (20A to 20D) discharge, for example, a liquid of respective colors of black (K), cyan (C), magenta (M), and yellow (Y).

The guides 12 and 13 hold the carriage 11 such that the carriage 11 is reciprocally movable in a main scanning direction indicated by arrow "X" in FIG. 2. The carriage 11 is coupled to a timing belt 17 wound around a driving pulley 15 driven by a main scanning motor 14 and a driven pulley 16 (see FIGS. 2 and 3). The main scanning motor 14 is driven to reciprocally move the carriage 11 in the main scanning direction X.

The printer 1 includes an encoder sheet 18 arranged along the main scanning direction X. The encoder sheet 18 includes a slit periodically formed on the encoder sheet 18. The carriage 11 includes a reading sensor that reads the slits of the encoder sheet 18. The printer 1 can detect the position of the carriage 11 in the main scanning direction X from a reading result of the reading sensor.

The printer 1 includes a controller board 50 that controls the head 20 to discharge an ink as a liquid from the head 20 at a timing when the carriage 11 is moved to a discharge position. A position of the carriage 11 is obtained from the reading result of the reading sensor of the carriage 11.

The carriage 11 mounts sub tanks on the carriage 11 such that the sub tanks and heads 20A to 20C respectively form a single unit. The sub tanks temporarily store the liquid to be supplied to the heads 20A to 20C. The liquid is supplied from the main tank 32 to the sub tanks on the carriage 11.

The printer 1 includes a platen 40 as a holder to hold a fabric 400 as a print target (liquid application target). The "print target (fabric 400)" may be simply referred to as a "target".

The printer 1 includes an elevator 41 on which the platen 40 is mounted. A position (height) of the elevator 41 is adjustable in a vertical direction indicated by arrow "Z" in FIG. 1. The printer 1 includes a slider 42 on which the elevator 41 of the platen 40 is mounted. The printer 1 includes a slider rail 43 on which the slider 42 is movably mounted. The slider rail 43 is extended along on a sub scanning direction indicated by arrow "Y." The sub scanning direction Y is perpendicular to the main scanning direction X. Thus, the slider 42 moves along the slider rail 43 in the sub-scanning direction Y.

The slider 42 is reciprocally movable in the sub scanning direction Y via the timing belt 45 by a sub scan drive mechanism. Reciprocal movement of the slider 42 in the sub scanning direction Y reciprocally moves the platen 40 in the sub scanning direction Y.

The printer 1 includes a maintenance device 60 to maintain and recover a discharge function the head 20. The maintenance device 60 is disposed on one side (right-side in FIGS. 2 and 3) of the printer 1 in the main scanning direction X. The maintenance device 60 includes a suction cap 61 to cap the nozzle surface 20*a* of the head 20, a moisture-keeping cap 62 to cap the nozzle surface 20*a* of the head 20 to keep moisture in the nozzles of the head 20, and the wiper 63 to wipe the nozzle surface 20*a* of the head 20. The nozzles are formed in the nozzle surface 20*a* of the head 20, and a liquid is discharged from the nozzles of the head 20. The suction cap 61 is coupled to a suction pump serving as a suction device.

The printer 1 includes a discharge receptacle 66 on another end (left end in FIGS. 2 and 3) of the printer 1 in the main scanning direction X. The controller board 50 controls the head 20 to discharge the liquid to the discharge receptacle 66 during printing to maintain and recover a discharge function of the head 20.

Further, the printer 1 includes a power button 70, an operation part 71, a power supply unit 72, and the like.

When the printer 1 prints on a fabric (print target) such as a T-shirt held on the platen 40, that is, the fabric 400 is set on the platen 40. Then, the operation part 71 is operated to completely pulls the platen 40 in a rear direction (upper-righthand direction in FIG. 1) of the printer 1 by moving the slider 42.

When the platen 40 is fully (completely) pulled inside the printer 1 (end of pull-in operation), the printer 1 becomes a print-data standby state. The printer 1 starts a print operation when the printer 1 receives print data from an external information processing device. Alternatively, the user may select the print data by the operation part 71 to start the print operation when the print data is previously stored in the controller board 50.

When the printer 1 starts the print operation, the printer 1 moves the slider 42 to move the platen 40 to a printing start position at which the printer 1 starts the print operation. Then, the printer 1 moves the carriage 11 while discharging a liquid from the head 20 to perform one line of printing on the fabric 400. When the printer 1 prints the one line, the printer 1 moves the slider 42 to move the platen 40 by one line. The printer 1 intermittently repeats one scanning movement of the carriage 11 in the main scanning direction X and a movement of the slider 42 in the sub scanning direction Y to print an image on a desired region of the fabric 400. The printer 1 moves the platen 40 back to a front side (lower-left direction in FIG. 1) of the printer 1 to finish the print operation.

Next, a head cap 600 according to the first embodiment of the present disclosure is described with reference to FIGS. 4 to 9.

Figure 4:
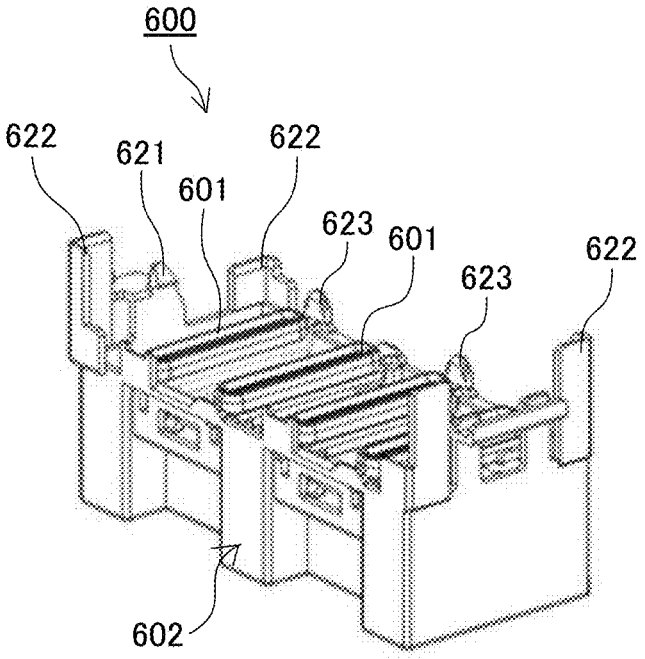
FIG. 4 is a schematic perspective view a head cap according to a first embodiment of the present disclosure.

FIG. 4 is a schematic perspective view of the head cap 600 according to the first embodiment of the present disclosure.

Figure 5:
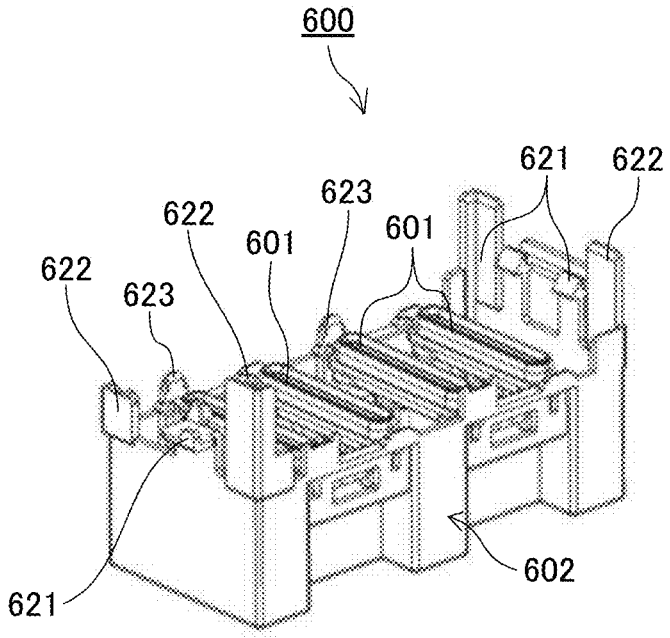
FIG. 5 is a perspective view of the head cap as seen from a direction different from FIG. 4.
Figure 6:
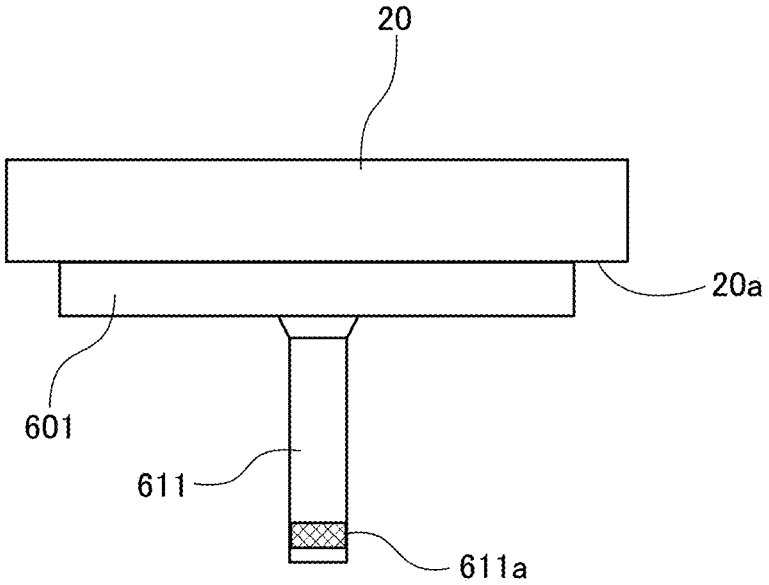
FIG. 6 is a front view of a cap in a capping state.

FIG. 5 is another schematic perspective view of the head cap 600 viewed from art angle different from FIG. 4, FIG. 6 is a front view of a cap 601 in a capping state.

Figure 7:
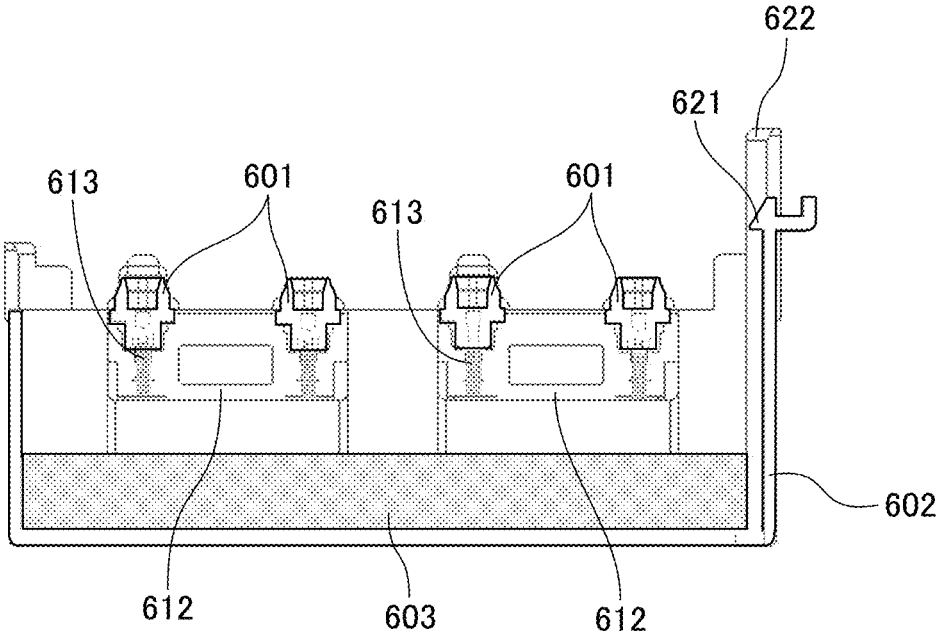
FIG. 7 is a cross-sectional front view of the head cap along a cap arrangement direction in which caps are arrayed.

FIG. 7 is a cross-sectional view of the head cap 600 along a cap arrangement direction in which multiple caps 601 are arrayed.

Figure 8:
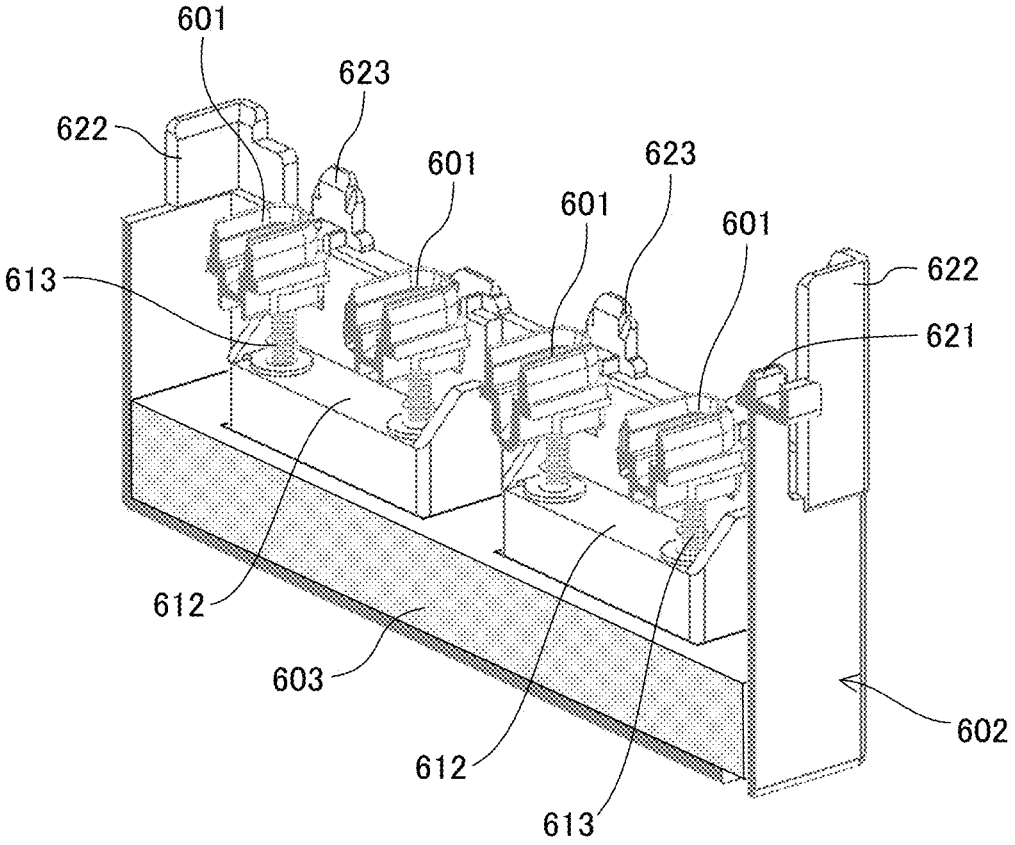
FIG. 8 is a schematic cross-sectional perspective view of the head cap.

FIG. 8 is a cross-sectional perspective view of the head cap 600.

Figure 9A:
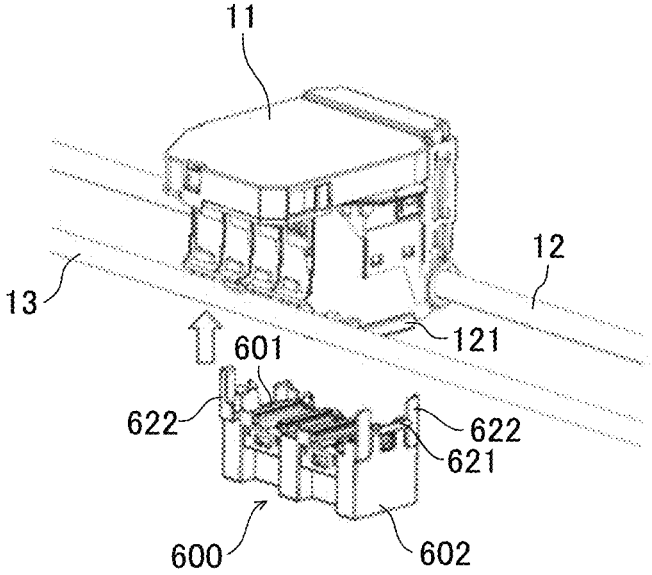
FIGS. 9A and 9B are a schematic perspective views of the head cap attached to the carriage.
Figure 9B:
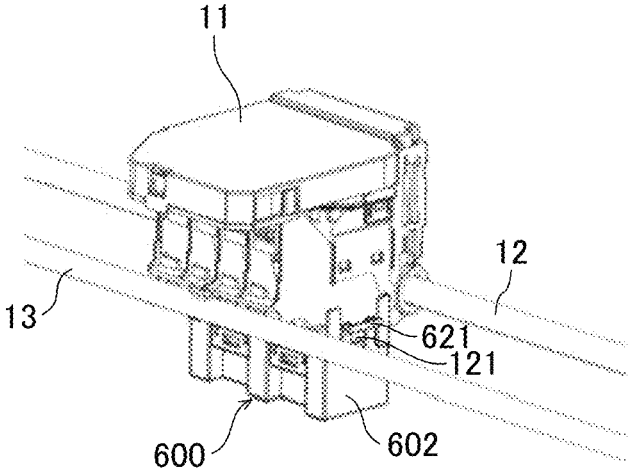

FIGS. 9A and 9B are a schematic perspective views of the head cap 600 attached to the carriage 11.

As illustrated in FIGS. 4 to 6, the head cap 600 includes the multiple caps 601 that respectively cap multiple nozzle surfaces 20*a* of the multiple heads 20 mounted on the carriage 11 and a holder 602 that holds the multiple caps 601. Hereinafter, the "multiple caps 601" may be simply referred to as the "caps 601".

The caps 601 (two caps 601 in FIG. 7) are provided in the holder 602. An interior of each of the caps 601 is sealed when the caps 601 cap the nozzles surfaces 20*a* of the heads 20.

As illustrated in FIG. 6, at least one cap 601 of the multiple caps 601 includes a sealed channel 611, and the sealed channel 611 is closed by a sealing 611*a*.

That is, the head cap 600 has a configuration in which members common to the suction cap 61 and the moisture-keeping cap 62 of the maintenance device 60 of the printer 1 are used to configure the multiple caps 601 of the head cap 600.

In the above configuration, the cap 601 corresponding to the suction cap 61 includes the sealed channel 611 closed by the sealing 611*a*, and the sealed channel 611 is coupled to the suction device. Similar to the cap 601 corresponding to the moisture-keeping cap 62, the cap 601 serving as the suction cap 61 caps the nozzle surface 20*a* of the head 20 so that an interior of the cap 601 is sealed during capping the nozzle surface 20*a* of the head 20.

In other words, the sealing 611*a* closes the sealed channel 611 of the cap 601 corresponding to the suction cap 61 so that the members common to the suction cap 61 and the moisture-keeping cap 62 in the maintenance device 60 of the printer 1 can be used to configure the cap 601 of the head cap 600.

Further, the sealing 611*a* closes the sealed channel 611 of the cap 601 corresponding to the suction cap 61, and the sealed channel 611 is coupled to the suction device. Thus, the sealing 611*a* prevents leakage of a moisture-keeping liquid in the cap 601 through the sealed channel 611 even when the moisture-keeping liquid is filled in the cap 601.

The head cap 600 includes a cap holder 612 that holds the multiple caps 601 such that the cap holder 612 holds couples of caps 601, and each couples of caps 601 has two caps 601. The head cap 600 includes an elastic member 613 such as a spring. The elastic member 613 is disposed between the cap 601 and the cap holder 612 so that the cap 601 is pressed against the nozzle surface 20*a* of the head 20 by the elastic member 613 when the cap 601 caps the nozzle surface 20*a* of the head 20.

The holder 602 includes hooks 621 (claws) as engaging portions at both ends of the holder 602 in the cap arrangement direction as illustrated in FIGS. 4 and 5. The hooks 621 are detachably attached to protrusions 121 (see FIG. 9) as engaged portions on an exterior of the carriage 11.

The hooks 621 serves as the engaging portion of the head cap 600. The hooks 621 are engageable with the protrusions 121 of the carriage 11 so that the hooks 621 can keep an attached state of the head cap 600 to the carriage 11. Thus, the hooks 621 (engaging portion) is configured to engageable to one of the carriage 11 and the guides 12 and 13 The protrusion 121 (engaged portion) is configured to be engageable with the hooks 621 (engaging portion) of the holder 602 of the head cap 600.

The holder 602 includes guides 622 at four corners of the holder 602. The guides 622 serve as a guide and positioning portions when the holder 602 is attached to the carriage 11.

The holder 602 includes positioning portions 623 to regulate a positional relationship between the cap 601 and the nozzle surface 20*a* of the head 20 in a longitudinal direction of the cap 601. The longitudinal direction of the cap 601 is perpendicular to the cap arrangement direction. The cap holders 612 respectively includes the positioning portions 623. For example, each of the cap holder 612 includes at least one positioning portions 623.

Further, the cap holder 612 includes an absorber 603 to absorb liquid. The absorber 603 is disposed below the cap holder 612 in the holder 602 as illustrated in FIG. 8.

Next, a head capping operation performed by the head cap 600 according to the first embodiment is described below.

There is a case in which the printer 1 stops due to a failure and the like, and the carriage 11 may not move to a capping position (maintenance position) of the maintenance device 60. In this case, the nozzles of the head 20 are exposed to the atmosphere until repair of the printer 1 by a service person or the like is completed. Therefore, liquid components in the ink or the like in the nozzles may evaporate to increase viscosity of the liquid, and the liquid having increased viscosity may fixed to the nozzles of the head 20.

Therefore, as illustrated in FIG. 9A, the head cap 600 is lifted upward from a lower side of the carriage 11 stopped in the middle while the guide 622 of the head cap 600 is aligned with the exterior of the carriage 11.

Then, as illustrated in FIG. 9B, the hooks 621 of the head cap 600 are engaged with the protrusions 121 of the carriage 11 so that the head cap 600 is attached to the carriage 11.

At this time, the cap 601 of the head cap 600 comes into contact with the nozzle surface 20*a* of the head 20 to cap the nozzle surface 20*a* of the head 20. The elastic member 613 biases the cap 601 toward the nozzle surface 20*a* of the head 20 to seal the nozzle surface 20*a* of the head 20.

Since the cap 601 seals the nozzle surface 20*a* of the head 20 from outside air, the cap 601 reduces an evaporation of moisture of the liquid in the nozzles of the head 20 than a configuration in which the nozzle surface 20*a* is not capped by the cap 601. Thus, the cap 601 prevents thickening and sticking of the liquid in the nozzles of the head 20.

As described above, the head cap 600 according to the first embodiment is used to manually reduce drying of the nozzles of the head 20 even when the maintenance device 60 cannot cap the head 20.

The nozzle surface 20*a* of the head 20 is capped with the cap 601 of the head cap 600 in a state in which an interior of the cap 601 is filled with a moisture-keeping liquid including a cleaning liquid or the like. Thus, the head cap 600 can keep the nozzle surface 20*a*, in which multiple nozzles are formed, in a moisture-keeping state. Thus, the head cap 600 can more reliably prevent evaporation of moisture of the liquid in the nozzles of the head 20, and thus prevent thickening and sticking of the liquid in the nozzles of the head 20.

In the above configuration, the cleaning liquid also serving as the moisture-keeping liquid is filled in the cap 601 so that the cleaning liquid contacts the nozzle surface 20*a* of the head 20 when the nozzle surface 20*a* of the head 20 is capped with the cap 601. Thus, the cap 601 can clean the nozzle surface 20*a* of the head 20 while the cap 601 can also keep the nozzle surface 20*a* of the head 20 in the moisture-keeping state. Further, the absorber 603 can absorb the moisture-keeping liquid when the moisture-keeping liquid filled in the cap 601 is spilled at the time of capping. Thus, the head cap 600 can prevent an interior of the printer 1 (apparatus) from being soiled by the moisture-keeping liquid.

It is difficult to attach the head cap 600 to the carriage 11 when the carriage 11 stops during printing since the carriage 11 is at a facing position facing the platen 40.

In such a case, a head capping method as described below is performed. As a first step, the platen 40 is moved from the facing position facing the head 20 to a position not facing the head 20. The platen 40 is a member that holds an application target to which the liquid is applied (discharged) from the nozzles of the head 20.

Then, as a second step, the holder 602 of the head cap 600 is attached to the carriage 11 so that the nozzle surface 20*a* of the head 20 is capped with the cap 601 of the head cap 600.

In the above manner, the platen 40 (a member holding the application target to which the liquid is applied) is movable with respect to the carriage 11 so that a capping operation by the head cap 600 is easily performed. The head cap 600 is attached to the carriage 11 in the capping operation.

Next, the head cap 600 according to a second embodiment of the present disclosure is described with reference to FIGS. 10 to 14.

Figure 10:
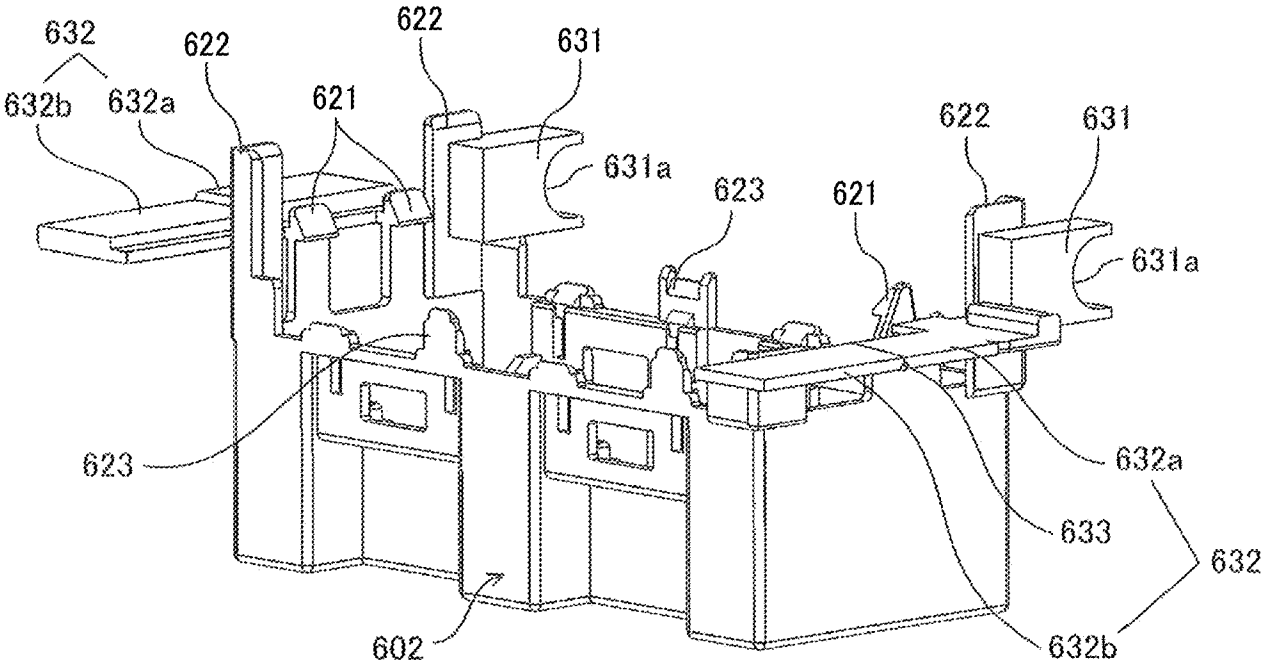
FIG. 10 is a schematic perspective view a holder of the head cap according to a second embodiment of the present disclosure.

FIG. 10 is a schematic perspective view of the holder 602 of the head cap 600 according to the second embodiment of the present disclosure.

Figure 11:
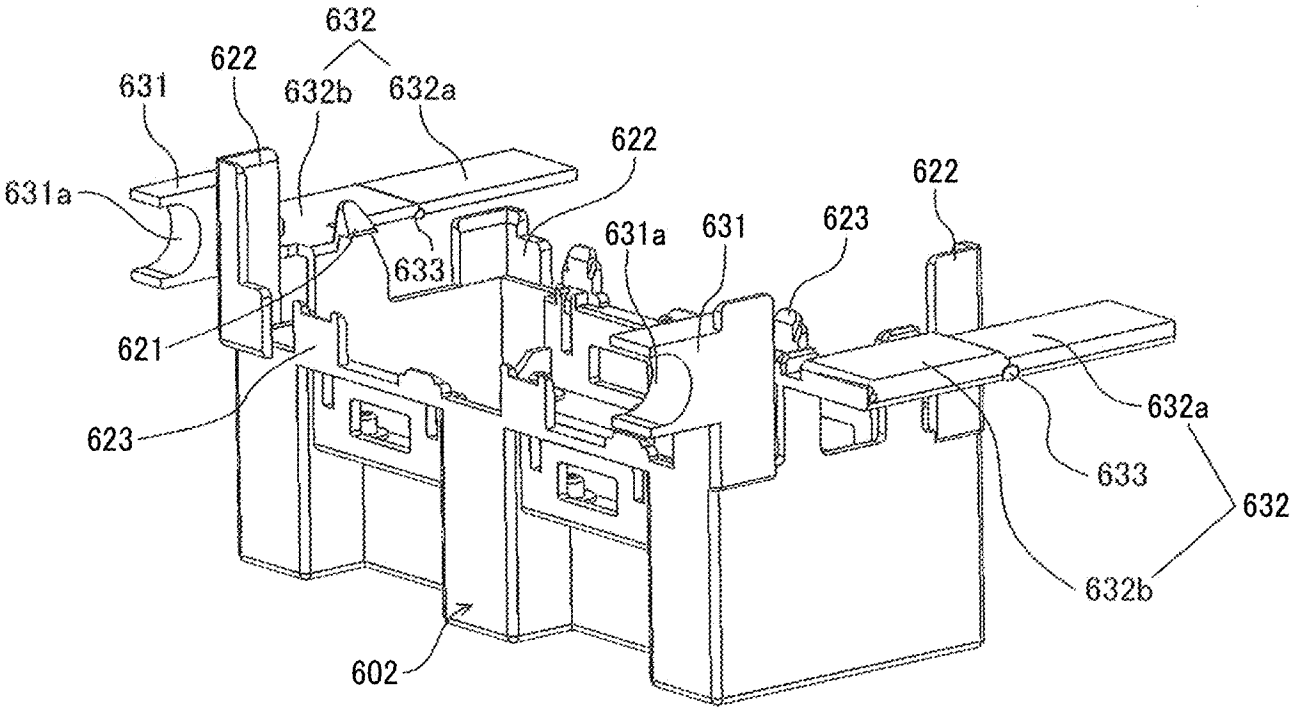
FIG. 11 is schematic perspective view of the holder of the head cap as seen from a direction different from FIG. 10.

FIG. 11 is schematic perspective view of the holder 602 of the head cap 600 as seen from a direction different from FIG. 10.

Figure 12:
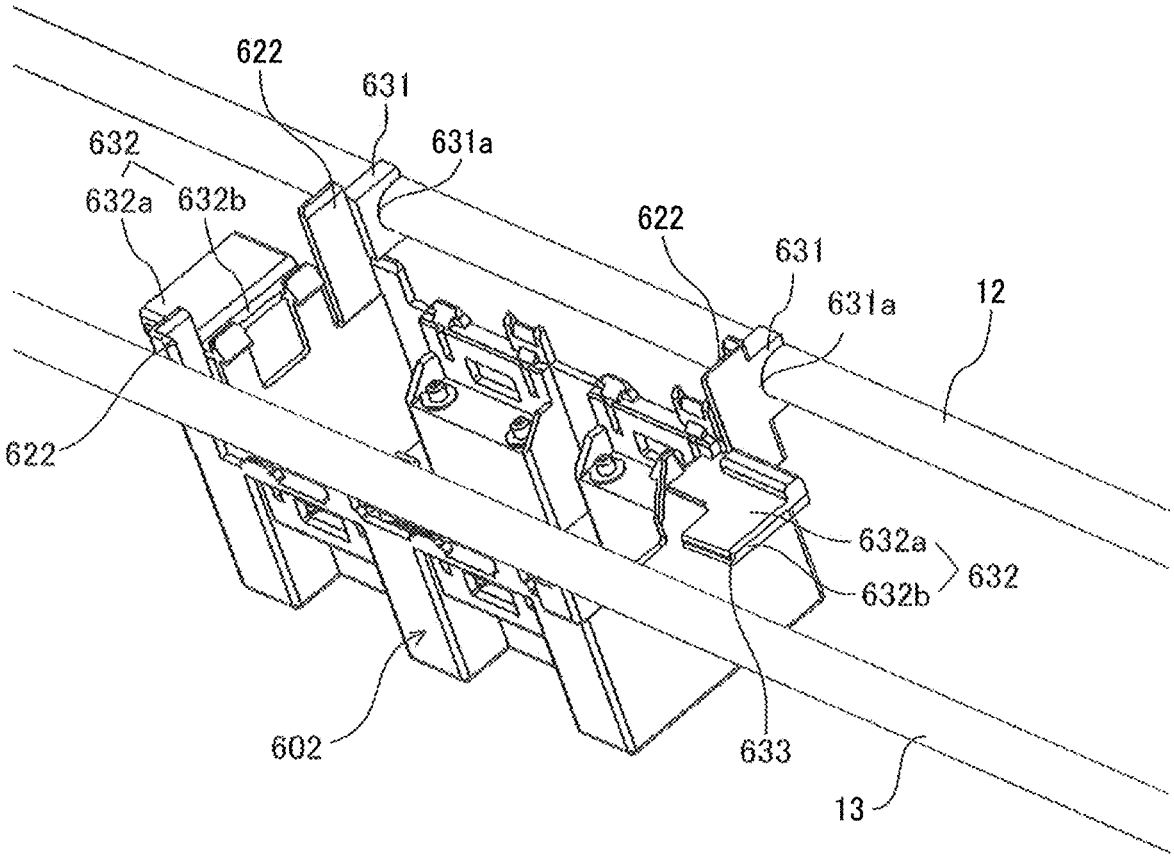
FIG. 12 is a schematic perspective view of the holder illustrating a process of attaching the holder to guides.

FIG. 12 is a schematic perspective view of the holder 602 illustrating a process of attaching the holder 602 to the guides 12.

Figure 13:
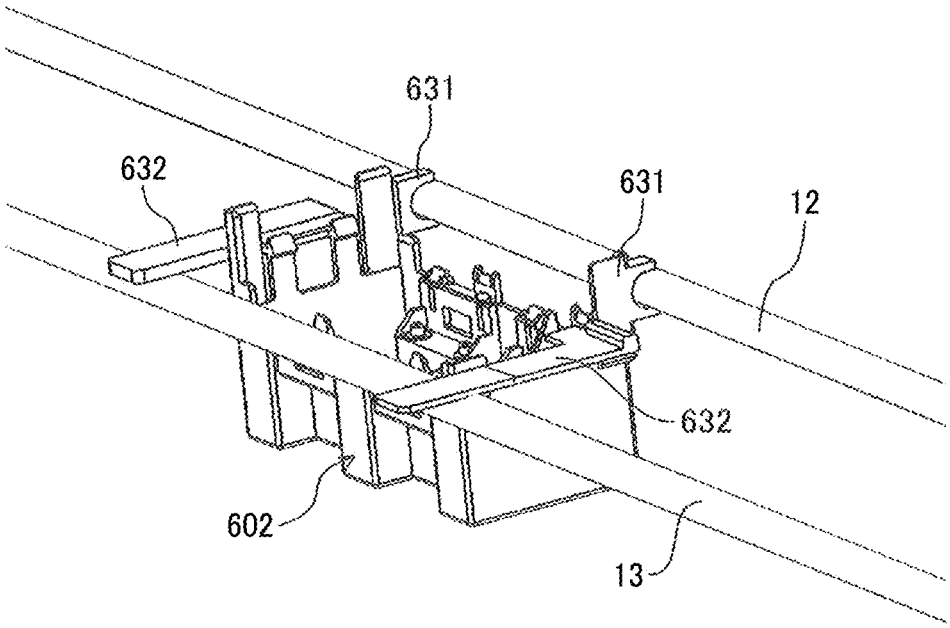
FIG. 13 is a schematic perspective view of the holder illustrating a state in which the holder is attached to the guides.

FIG. 13 is a schematic perspective view of the holder 602 illustrating a state in which the holder 602 is attached to the guides 12.

Figure 14:
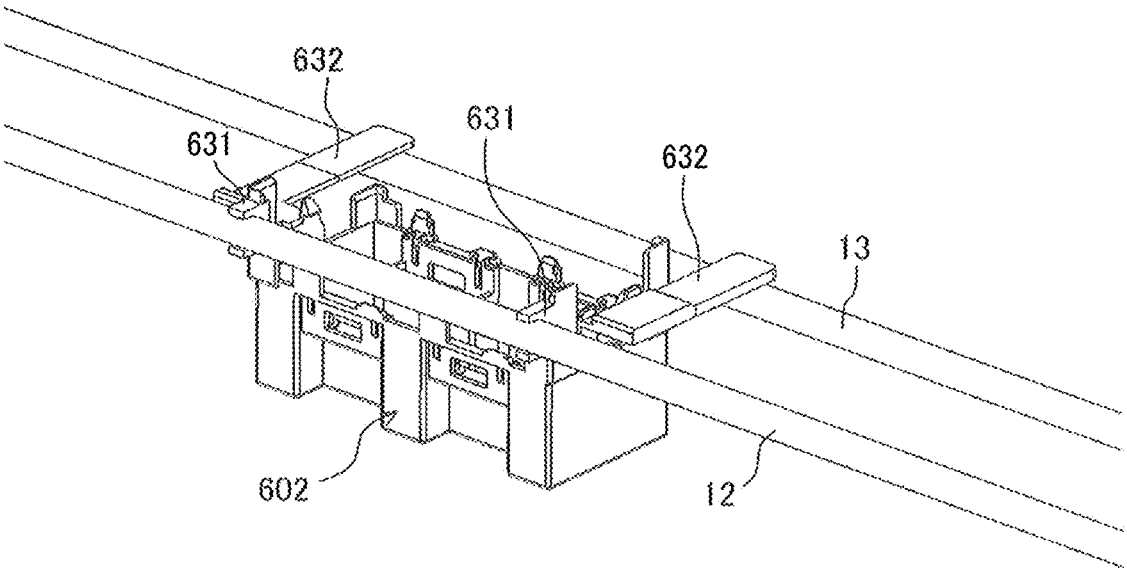
FIG. 14 is a perspective view of the printer as seen from a direction different from FIG. 13.

FIG. 14 is a schematic perspective view of the holder 602 as seen from a direction different from a direction illustrated in FIG. 13.

The holder 602 according to the second embodiment includes first engaging portions 631 that engage with the guide 12 as a first guide and second engaging portions 632 that engage with the guide 13 as a second guide.

Each of the first engaging portion 631 has a substantially semicircular recess 631*a* (fitting portion) following a peripheral surface of the guide 12. Each of the second engaging portion 632 has arms 632*a* and 632*b* that are foldable by the hinge 633.

When the holder 602 of the head cap 600 is attached to the guides 12 and 13 as guides, the arms 632*a* and 632*b* of the second engaging portions 632 are folded as illustrated in FIG. 12. Thus, an upper portion of the holder 602 can pass through a space between the guides 12 and 13 as illustrated in FIGS. 12 and 13.

Then, as illustrated in FIG. 12, the holder 602 is passed through the space between the guides 12 and 13, and the recesses 631*a* of the first engaging portions 631 are hooked on the peripheral surface of the guide 12.

Next, as illustrated in FIGS. 13 and 14, the arms 632*a* and 632*b* of each of the second engaging portions 632 of the holder 602 are unfolded, and the second engaging portions 632 are placed on the guide 13.

Thus, the holder 602 is attached to the guides 12 and 13, and the head cap 600 is attached to the guides 12 and 13.

In the head cap 600 according to the second embodiment, the holder 602 also includes the engaging portion (hooks 621) described in the first embodiment as illustrated in FIGS. 4 to 8. In the above way, the holder 602 is attachable to any one of the carriage 11 or the guides 12 and 13. Thus, the holder 602 is attachable to one of the carriage 11 and the guides 13. However, the holder 602 may not include the engaging portion as described in the first embodiment.

In the above-described embodiments, the printer to print an image on a cloth as an object to which a liquid is applied is described. The printer is an example of the liquid discharge apparatus that is detachably attachable a head cap (head cleaner) as described above. However, the liquid discharge apparatus is not limited to the printer that prints on the cloth. For example, the liquid discharge apparatus may be a printer that discharge a liquid onto a sheet material as the object to which a liquid is applied.

In the above-described embodiments, the head cap 600 includes the hooks 621 serving as the engaging portion. However, the carriage 11 or the guides 12 and 13 (guides) may also include the hooks 621 serving as the engaging portion. Further, the engaging portion may have a configuration other than the hooks 621 (claws). For example, a magnet may be used as the engaging portion to detachably attached the head cap 600 to the carriage 11.

In the above-described embodiments, the "liquid discharge apparatus" includes the head or the liquid discharge device and drives the head to discharge a liquid. The liquid discharge apparatus may be, for example, an apparatus capable of discharging liquid to a material onto which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material onto which liquid at least temporarily adheres, a material onto which liquid adheres and fixes, or a material onto which liquid adheres to permeate.

Examples of the "material onto which liquid can adhere" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid can adhere" includes any material on which liquid adheres unless particularly limited.

Examples of the "material onto which liquid can adhere" include any materials on which liquid can adhere even temporarily, such as paper, thread, fiber, fabric, leather, metal, plastic, glass, wood, and ceramic.

Further, the term "liquid" includes any liquid having a viscosity or a surface tension that is dischargeable from the head.

However, preferably, the viscosity of the liquid is not greater than 30 MPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The liquid discharge apparatus may be an apparatus to relatively move the head and a material on which liquid can adhere.

However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the sheet with the treatment liquid to reform the sheet surface and an injection granulation apparatus to discharge a composition liquid including a raw material dispersed in a solution from a nozzle to mold particles of the raw material.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A head cap configured to maintain a head configured to discharge a liquid from nozzles formed in a nozzle surface, the head cap comprising:

a cap configured to cap the nozzle surface of the head; and a holder holding the cap, the holder being detachably attachable to one of a carriage mounting the head and a guide configured to guide the carriage.

2. The head cap according to claim 1, wherein the holder includes an absorber configured to absorb a liquid in the holder.

3. The head cap according to claim 2, wherein the absorber is disposed below the cap.

4. The head cap according to claim 1, the cap is sealed by the nozzle surface in a state in which the holder is attached to at least one of the carriage and the guide.

5. The head cap according to claim 1, wherein the holder includes an engaging portion engageable with one of the carriage and the guide.

6. The head cap according to claim 5, wherein the engaging portion of the holder is a hook.

7. The head cap according to claim 6, wherein the hook of the holder is engageable with a protrusion on the carriage.

8. A liquid discharge apparatus comprising:

a head including nozzles formed in a nozzle surface, the head configured to discharge a liquid from the nozzles;

a carriage mounting the head;

a guide configured to guide the carriage; and the head cap according to claim 5, wherein the carriage includes an engaged portion engageable with the engaging portion of the holder of the head cap.

9. The liquid discharge apparatus according to claim 8, further comprising:

a maintenance device configured to maintain the head, wherein the maintenance device includes:

a cap configured to cap the nozzle surface of the head; and a wiper configured to wipe the nozzle surface of the head.

10. The liquid discharge apparatus according to claim 8 wherein the head cap includes a sealed channel coupled to the cap, and the sealed channel is closed by a sealing.

11. The liquid discharge apparatus according to claim 8, wherein the head is configured to discharge the liquid onto a target, and the target is a fabric.

12. The liquid discharge apparatus according to claim 8, further comprising:

a platen configured to hold a target, wherein the head is configured to discharge the liquid onto the target held by the platen, and the platen is movable between a first position at which the platen faces the head and a second position at which the platen does not face the head.

13. A head capping method comprising:

moving a platen configured to hold a target from a first position at which the platen faces a head to a second position at which the platen does not face the head, the head configured to discharge a liquid from nozzles formed in a nozzle surface onto the target;

attaching the head cap according to claim 1 to one of the carriage mounting the head and a guide configured to guide the carriage; and capping the nozzle surface of the head with the head cap.

14. The head cap according to claim 1, wherein based on the holder being detachably attached to one of the carriage mounting the head and the guide, the holder is in direct contact with the detachably attached one of the carriage mounting the head and the guide.

* * * * *